United States Patent [19]

Hansen

[11] 4,405,680

[45] Sep. 20, 1983

[54] ROOFING SHINGLE

[75] Inventor: David R. Hansen, Houston, Tex.

[73] Assignee: Shell Oil Company, Houston, Tex.

[21] Appl. No.: 452,595

[22] Filed: Dec. 23, 1982

[51] Int. Cl.[3] ..... B32B 15/00

[52] U.S. Cl. ..... 428/285; 428/141; 428/143; 428/291; 428/323; 428/489

[58] Field of Search ..... 428/141, 143, 285, 291, 428/489, 323

[56] References Cited

U.S. PATENT DOCUMENTS

| | | | |
|---|---|---|---|
| 3,096,196 | 7/1963 | Bettoli et al. | 428/489 |
| 3,931,440 | 1/1976 | Shepherd et al. | 428/285 |
| 4,082,885 | 4/1978 | Roshid et al. | 428/489 |
| 4,135,022 | 1/1979 | Kennepohl et al. | 428/489 |
| 4,259,127 | 3/1981 | Schachter | 428/489 |
| 4,269,886 | 5/1981 | Bondoc | 428/291 |
| 4,357,377 | 11/1982 | Yamamoto | 428/489 |

*Primary Examiner*—James J. Bell

*Attorney, Agent, or Firm*—Peter A. Bielinski

[57] ABSTRACT

This invention relates to a roofing shingle having improved low temperature flexibility comprising a flexibilized mat prepared by impregnating a glass fiber web with the blend of an unblown asphalt and a monoalkenyl arene-conjugated diene block copolymer, wherein the flexibilized mat is coated with a blend of an air-blown bitumen and a filler.

7 Claims, No Drawings

ROOFING SHINGLE

BACKGROUND OF THE INVENTION

1. Field of the Invention

The present invention relates to a roofing shingle. More particularly, the present invention relates to a roofing shingle having improved low temperature flexibility.

2. Description of the Prior Art

Glass mat based asphalt roofing shingles and built up roofs (BUR) are becoming increasingly popular because of their Class A fire rating (shingles), durability, and resistance to rotting. These products, however, suffer from one major deficiency during installation and that is embrittlement below 40° F. Present glass mat shingles will tear and fracture easily at low temperatures. Asphalt saturated glass mats for BUR are hard to unroll and can even fracture when applied at low temperatures. What is needed is an asphalt based shingle that is not only durable, but which has acceptable low temperature properties.

SUMMARY OF THE INVENTION

The present invention relates to glass mats impregnated with modified asphalts and to roofing shingles having an unexpectedly improved balance of properties. More particularly, the present invention relates to a roofing shingle having increased low temperature flexibility, increased tear strength and improved impact resistance. In a specific embodiment, the present invention is a roofing shingle comprising:

(a) a flexibilized mat prepared by impregnating a resin bonded glass mat with a mixture of about 70 to about 94 percent by weight of an unblown bitumen having an asphaltene (heptane insolubles) content below twenty percent by weight and about 6 to about 30 percent by weight of a monoalkenyl arene-conjugated diene block copolymer; and (b) an asphalt composition coated on at least one surface of said flexibilized mat, said asphalt composition comprising the blend of a blown bitumen and a filler, said asphalt composition having a softening point of about 100° C. to about 120° C.

As shown in the Illustrative Embodiments which follow, impregnated glass mats prepared according to the present invention have tear strengths nearly ten times greater than the unmodified glass mats, even at low temperatures.

In a preferred embodiment, the block copolymer component and unblown bitumen component are selected so that the resulting blend is compatible and has a Ring and Ball softening point, °C., of between 85° and 130°.

DETAILED DESCRIPTION OF THE INVENTION

Initially, a flexibilized mat is prepared by impregnating a fiber glass mat with a mixture of a monoalkenyl arene-conjugated diene block copolymer and a compatible, unblown bitumen, said bitumen having an asphaltene content below 20 percent by weight.

The fiber glass mats employed in this invention are commercial glass mats used to make shingles, and are made by the "wet process". Conventionally these types of glass mats are made from about ¾ inch long glass fibers dispersed or pulped in water (like paper pulp). The pulped product is formed into a flat mat with the water being drained away. Typically a phenol formaldehyde or urea formaldehyde resin is sprayed onto the mat and the composite is cured in a hot oven. The mat is then wound up onto large rolls for use.

The block copolymers employed in the present composition are thermoplastic elastomers and have at least two monoalkenyl arene polymer end blocks A and at least one elastomeric conjugated diene polymer mid block B. The number of blocks in the block copolymer is not of special importance and the macromolecular configuration may be linear, graft, radial or star depending upon the method by which the block copolymer is formed. Typical block copolymers of the most simple configuration would have the structure polystyrene-polyisoprene-polystyrene and polystyrene-polybutadiene-polystyrene. A typical radial or star polymer would comprise one in which the diene block has three to four branches (radial) or five or more branches (star), the tip of most or all of the branches being connected to a polystyrene block. Other useful monoalkenyl arenes from which the thermoplastic (non-elastomeric) blocks may be formed include alphamethyl styrene, tert-butyl styrene and other ring alkylated styrenes as well as mixtures of the same. The conjugated diene monomer preferably has 4 to 5 carbon atoms, such as butadiene and isoprene. A much preferred conjugated diene is butadiene.

The average molecular weights of each of the blocks may be varied as desired. The monoalkenyl arene polymer blocks preferably have average molecular weights between about 5,000 and 125,000, more preferably between about 7,000 and about 50,000. The elastomeric conjugated diene polymer blocks preferably have average molecular weights between about 15,000 and about 250,000, more preferably between about 25,000 and about 150,000. The average molecular weights of the polystyrene end blocks are determined by gel permeation chromotography, whereas the polystyrene content of the polymer is measured by infrared spectroscopy of the finished block polymer. The weight percentage of the thermoplastic monoalkenyl arene blocks in the finished block polymer should be between about 8 and 65%, preferably between about 10% and about 30% by weight. The general type and preparation of these block copolymers are described in U.S. Pat. No. Re 28,246 and in many other U.S. and foreign patents.

The block copolymers useful in the compositions of this invention may also be hydrogenated either selectively, randomly or completely. Selected conditions may be employed, for example, to hydrogenate the elastomeric diene center block while not so modifying the monoalkenyl arene polymer end blocks. Two examples of hydrogenated polymers are polystyrene-hydrogenated polyisoprene-polystyrene and polystyrene-hydrogenated polybutadiene-polystyrene. Preferably blocks A are characterized in that no more than about 25% of the original aromatic double bonds are reduced by hydrogenation while blocks B are characterized by having at least 75% of the aliphatic double bonds reduced by hydrogenation. See generally U.S. Pat. No. 3,595,942.

The bitumen component employed with the block copolymer to make the flexibilized mat is generally an unblown bitumen having an asphaltene content below 20 percent by weight, preferably between 2 and 10 percent by weight asphaltenes. In addition to having a low asphaltene content, it is important for compatibility that the relative amounts of bitumen and block copolymer be within certain ranges. Accordingly, the following relative amounts of bitumen and block copolymer are employed (expressed as percent by weight):

| | Preferred | More Preferred |
|---|---|---|
| Block copolymer | 6 to 30 | 5 to 15 |
| Bitumen | 94 to 70 | 95 to 85 |

Fillers such as talc, calcium carbonate, silicas, fly ash, asbestos, slate dust, wood flour, etc. can also be added to the rubber asphalt mixture (at levels of 0–80 wt%). As shown in Table 1 there is little effect on the low temperature mandrel bend properties by adding up to 60 wt% calcium carbonate.

The bitumen can be straight run residues from the vacuum distillation column of a petroleum refinery or combinations of residues with appropriate cuts from the vaccum distillation column. Straight run residues can also be extracted with propane to produce what are called propane precipitated asphalts. These products can be blended back with appropriate residues, residue derived streams or cuts from the vacuum distillation column. Generally, it is preferred to have less than 20% asphaltenes (less than 10% being preferred) in the asphalt so that it will form a compatible mixture with the thermoplastic rubber. Compatibility is usually measured by holding a blend of the rubber and asphalt for 5 days at 160° C. in a can with a nitrogen atmosphere. After cooling the can is cut in half and properties of the material in the top and bottom of the can are measured to see if there is any significant difference of properties due to phase separation. In the case of an incompatible asphalt the rubber will usually float to the surface.

The penetration of the unblown asphalts can range from 10–400 pen (0.1 mm at 25° C.) with 80–200 pen generally preferred.

The flexibilized mat is prepared by impregnating the glass fiber mat in a molten mixture of the block copolymer and bitumen. Impregnation can be carried out in a number of ways. Roll or dip coaters with duct or blades or nip rolls can be used to apply the appropriate weight of material. Alternately slot dies or curtain coaters can also be used. It usually helps, however, to have some type of pressure or nip to ensure that the modified asphalt has penetrated the glass mat properly.

Next, the shingle is prepared by coating at least one surface (preferably both surfaces) of the flexibilized mat with an asphalt composition comprising the blend of a blown bitumen and a filler, said asphalt composition having a softening point of about 100° C. to about 120° C.

As is understood by those skilled in the art, blown asphalt is an asphalt or bitumen which has been oxidized by heating it and then passing air or a like oxidizing gas through the asphalt while maintained at an elevated temperature. The primary difference of blown asphalt as compound to ordinary asphalt stems from the fact that the softening point of blown asphalt is increased. It has been postulated that the oxidation of the asphalt brings about further condensation of aromatic and cyclic hydrocarbon rings contained in the asphalt to form a greater proportion of higher molecular weight components.

The coating mateial contains the blown bitumen and a filler. Suitable fillers include fly ash, asbestos, wood floor, siliceous fillers such as silicates, talc and calcareous fillers. The preferred fillers are slate dust and/or limestone. Mixtures of different fillers may be used. Suitable amounts of inorganic filler are from 1 to 80% w, preferably from 45 to 60% w, based on weight of the mixture.

The shingles may contain other components such as granules, sealing tabs and sand or talc. The general design and general preparation of such shingles are left to those skilled in the art.

The invention is further illustrated by means of the following illustrative embodiments which are given for the purposes of illustration only and are not meant to limit the invention to the particular reactants and amounts disclosed.

ILLUSTRATIVE EMBODIMENT I

In illustrative Embodiment I various roofing shingles were prepared according to the invention. In this embodiment, KRATON 1101 was blended with two different compatible asphalts (15 weight percent rubber); AR-1000 from Martinez, California and a Deer Park (Texas) blend of asphalts.

The AR-1000 bitumen is a commercially available road flux while the Deer Park bitumen blend is a blend of two asphalts. Blends were made with a 100-L Ross mixer at 170°–180° C. in 40–60 minutes. The blend was then poured onto two different commercial glass mats used for making shingles. After cooling, the glass mats with the rubberized asphalts were passed two to four times between two fixed heated rolls (350° F.) spaced 25 mils apart until the desired coat weight was distributed uniformly across the glass mat (10–13 lbs/100 square feet). The mats were then tested for tear strength by a trouser tear test and by a Elmendorf tear test. Tables 2 and 3 show that the tear strength of the glass mat is significantly improved, up to ten times even at low temperatures. Moreover, the rubberized asphalts are significantly better than the conventional coating asphalt in improving the tear strength of the glass mat (2–5 times).

A "psuedo shingle" was also constructed by compression molding the saturated and unsaturated glass mats between commercial highly filled coating asphalt at 120° C. for five minutes. The coating asphalt wasa blown asphalt used commercially in the manufacture of shingles and had a softening point of 102° C. It was filled with 55% calcium carbonate filler. The total construction was approximately ⅛ inch thick. One inch strips were placed in a cold box at 32° F. (0° C.) and struck with a hammer. The "pseudo shingle" with no rubberized asphalt saturant typically shattered. The KRATON rubber modified glass mat shingle, however, did not shatter. The outside coating asphalt layer cracked, as would be expected, but the crack did not propogate through the glass mat saturated with the rubberized asphalt.

TABLE 1

AR-1000 with 15% KRATON 1101 - Modified Asphalt Base

| Filler level in Modified Asphalt | Cold Mandrel Bend* (°F.) | Penetration 0.1 mm @ 25° C. | Ring & Ball (°F.) | Viscosity at 180° C. cps |
|---|---|---|---|---|
| 0 wt % | −20 | 53 | 210 | 2,500 |
| 20 wt % Vicron 25-11** | −20 | 43 | 211 | 3,550 |
| 40 wt % Vicron 25-11 | less than −30 | 34 | 218 | 5,350 |

TABLE 1-continued

AR-1000 with 15% KRATON 1101 - Modified Asphalt Base

| Filler level in Modified Asphalt | Cold Mandrel Bend* (°F.) | Penetration 0.1 mm @ 25° C. | Ring & Ball (°F.) | Viscosity at 180° C. cps |
|---|---|---|---|---|
| 60 wt % Vicron 25-11 | −30 | 21 | 216 | 17,970 |

*Bend of ⅛" thick strip over 1.2" diameter mandrel in 5 seonds. Temperature reported is the temperature at which sample cracks during bending.

**Vicron 25-11 calcium carbonate from Pfiezer.

TABLE 2

TROUSER TEAR STRENGTH

| | TEAR STRENGTH (LBS) | | |
|---|---|---|---|
| | 40° F. | 30° F. | 20° F. |
| 1. Glass Mat 1 | 0.4 | 0.6 | 0.6 |
| 2. Glass Mat 1 Saturated with Coating Asphalt | 1.1 | 1.0 | 2.4 |
| 3. Glass Mat 1 Saturated with Deer Park Compatible Asphalt + 15% KRATON ® 1101 | 3.5 | 4.5 | 6.0 |

TABLE 3

ELMENDORF TEAR (ASTM D-1922)

| SAMPLE | GRAMS/MIL |
|---|---|
| | ‖/⊥ to Machine Direction |
| Glass Mat 1 | 10/11 |
| Glass Mat 1 Saturated with Coating Asphalt | 20/18 |
| Glass Mat 1 Saturated with AR-1000 + 15% KRATON ® 1101 | 47/45 |
| Glass Mat 2 | 12/14 |
| Glass Mat 2 | 61/47 |

TABLE 3-continued

ELMENDORF TEAR (ASTM D-1922)

| SAMPLE | GRAMS/MIL |
|---|---|
| Saturated with AR-1000 + 15% KRATON ® 1101 | |

What is claimed is:

1. A roofing shingle having improved low temperature flexibility comprising:

(a) a flexibilized mat prepared by impregnating a fiber glass mat with a mixture of about 70 to about 94 percent by weight of an unblown bitumen having an asphaltene content (heptane insolubles) below twenty percent by weight and about 6 to about 30 percent by weight of a monoalkenyl arene-conjugated diene block copolymer; and (b) an asphalt composition coated on at least one surface of said flexibilized mat, said asphalt composition comprising the blend of a blown bitumen and a filler, said asphalt composition having a softening point of about 100° C. to about 120°0 C.

2. The shingle according to claim 1 wherein said block copolymer is a styrene-butadiene block copolymer.

3. The shingle according to claim 1 wherein said filler is calcium carbonate.

4. The shingle according to claim 1 wherein said block copolymer component and said unblown bitumen component are selected such that the resulting mixture is compatible and has a Ring and Ball softening point of between about 85° C. and about 130° C.

5. The shingle according to claim 1 wherein the amount of filler in the blend of said blown bitumen and said filler is between about one percent by weight and 80 percent by weight.

6. The shingle according to claim 1 wherein said fiber glass mat is formed from resin modified glass fibers.

7. The shingle according to claim 6 wherein said resin is selected from the group consisting of phenol formaldehyde resins and urea formaldehyde resins.

* * * * *